US005769770A

United States Patent [19]

Savage

[11] Patent Number: 5,769,770

[45] **Date of Patent: *Jun. 23, 1998**

[54] WRAPPED-BOX

[76] Inventor: Tommy R. Savage, 14100 Montfort Dr. #2248, Dallas, Tex. 75240

[ * ] Notice: The term of this patent shall not extend beyond the expiration date of Pat. No. 5,245,815.

[21] Appl. No.: 796,264

[22] Filed: Feb. 6, 1997

Related U.S. Application Data

[63] Continuation of Ser. No. 15,209, Mar. 23, 1993, which is a continuation-in-part of Ser. No. 933,493, Aug. 21, 1992, Pat. No. 5,245,815.

[51] Int. Cl.[6] ..... B31B 1/00

[52] U.S. Cl. ..... 493/111; 493/100; 229/87.19; 229/923

[58] Field of Search ..... 493/96, 100, 110, 493/111, 114, 115, 116, 137; 53/458, 456, 491; 229/87.19, 923

[56] References Cited

U.S. PATENT DOCUMENTS 2,479,456 8/1949 Arthur .
4,005,814 2/1977 Foster ..... 229/39

*Primary Examiner*—Jack W. Lavinder
*Attorney, Agent, or Firm*—Irell & Manella LLP

[57] ABSTRACT

The present invention provides a method of forming a pre-wrapped gift package which appears to have been hand wrapped. The method includes forming a sheet of box construction material with decorative paper affixed thereto into a box tube by joining ends thereof. The box construction material is properly creased and provided with flaps so that a consumer may fold the flattened box tube into a box so that the end flaps form ends of the box and the decorative paper forms a pair of paper flaps which may be overlapped and taped.

25 Claims, 3 Drawing Sheets

FIG. 1
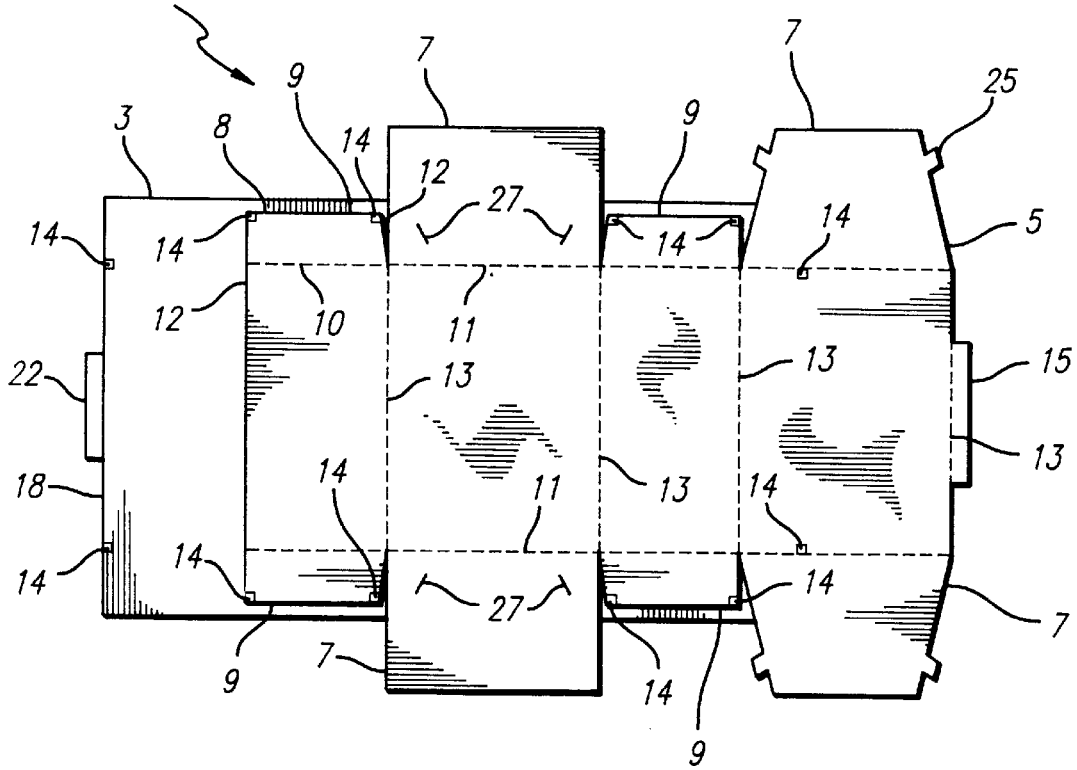
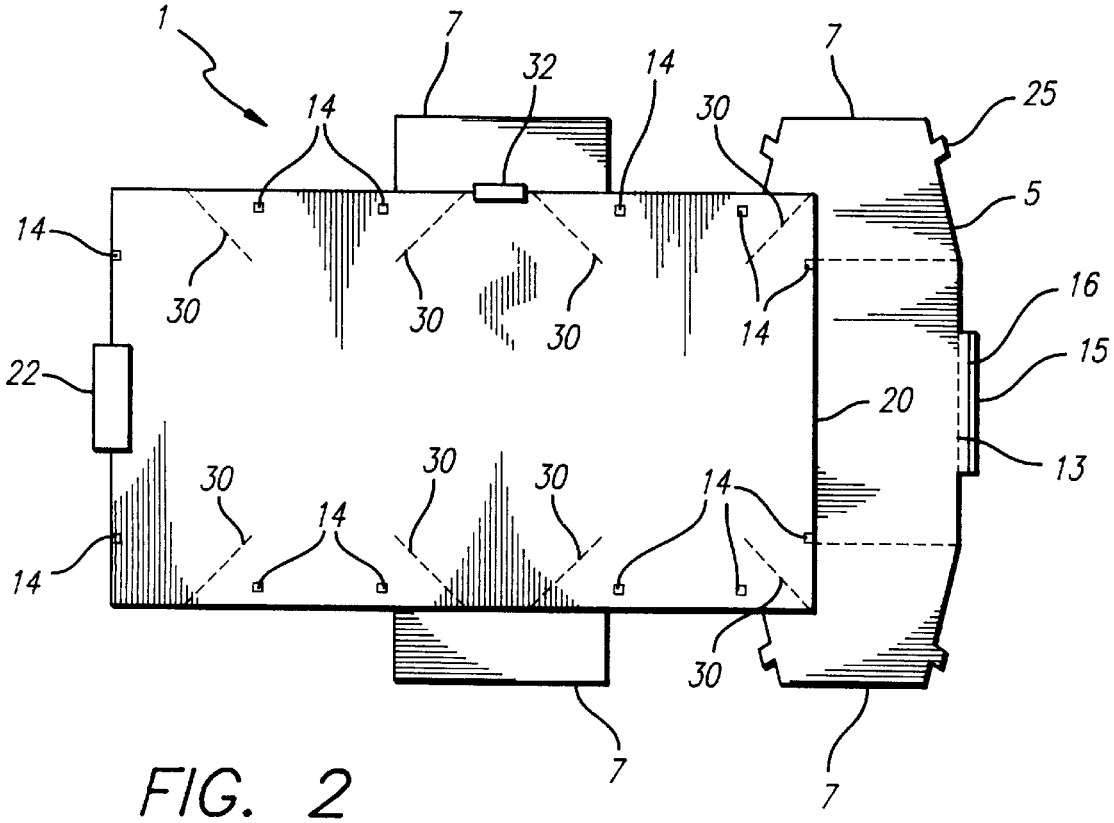
FIG. 2

FIG. 3
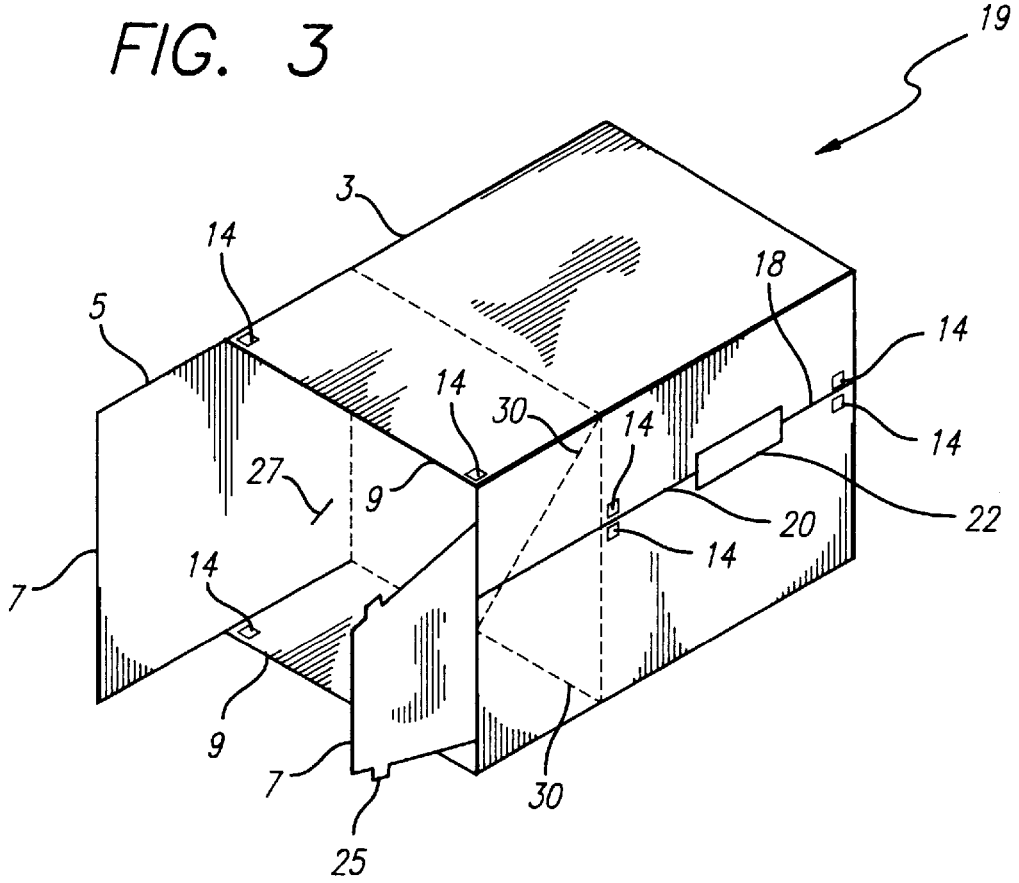
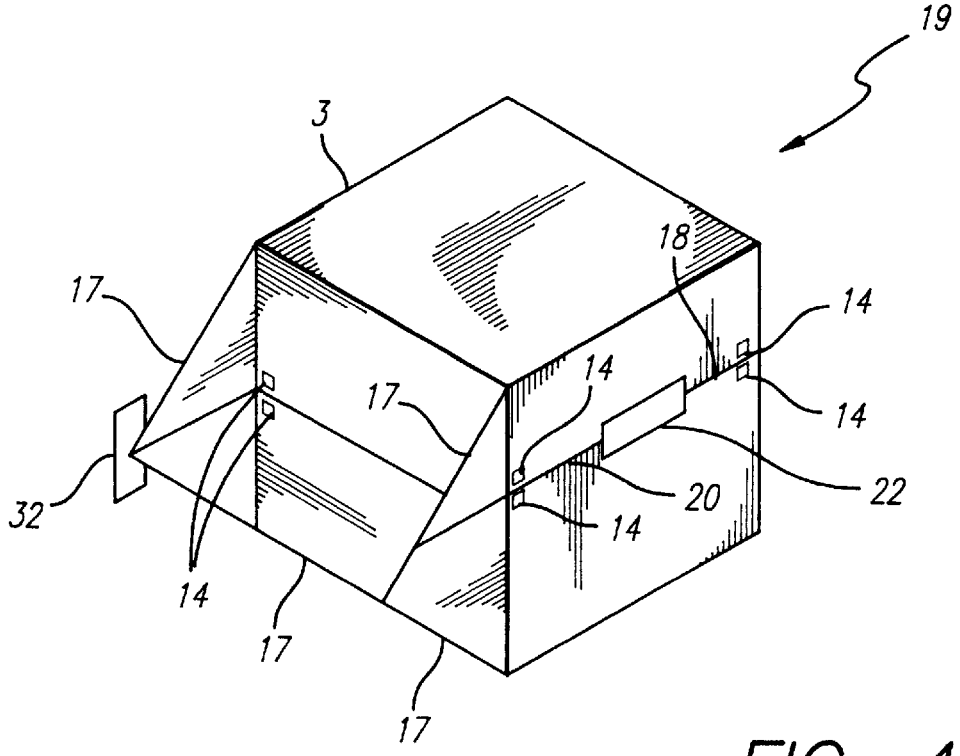
FIG. 4

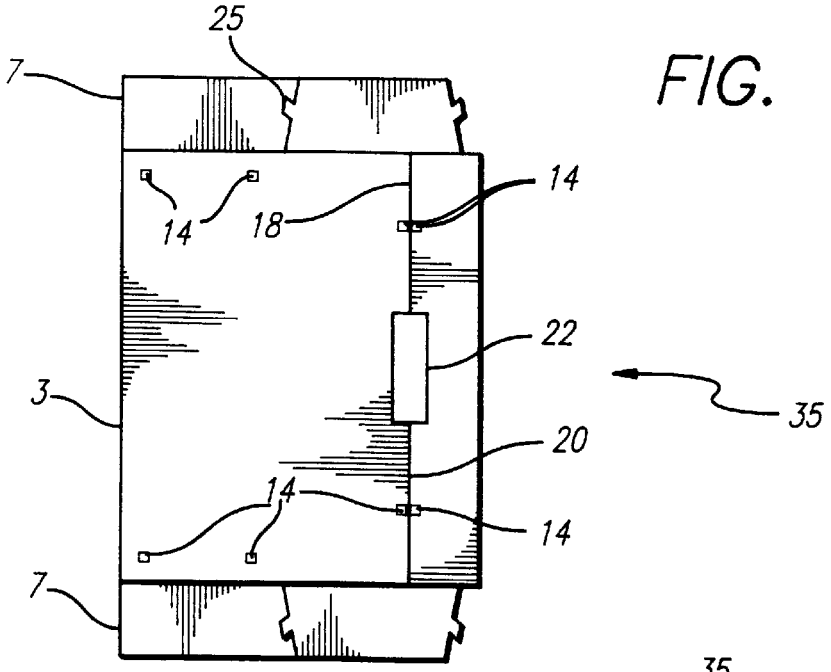
FIG. 5
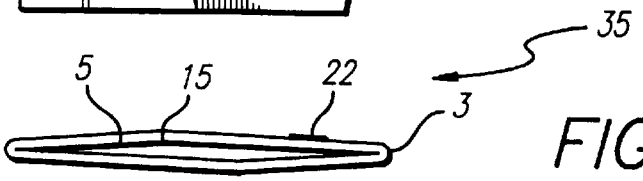
FIG. 6
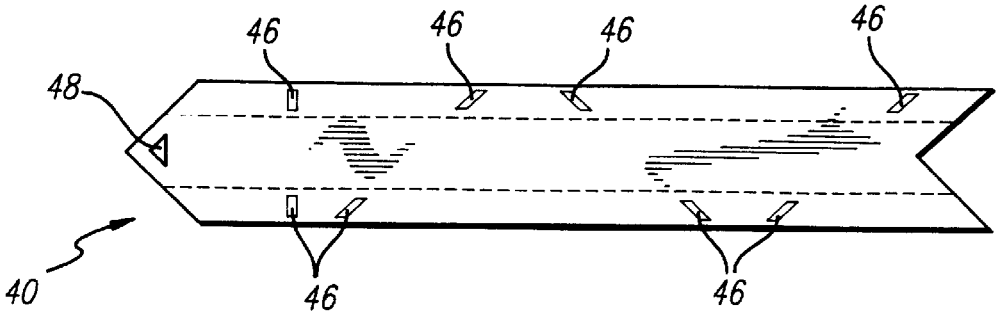

WRAPPED-BOX

CROSS REFERENCE TO RELATED APPLICATION(S)

This application is a continuation of U.S. patent application Ser. No. 08/015/209, filed Mar. 23, 1993, still pending which is a continuation-in-part application Ser. No. 933,493 of U.S. Pat. No. 5,245,815, now of application filed Aug. 21, 1992.

BACKGROUND OF THE INVENTION

1. Field of the Invention

The present invention relates generally to the field of gift wrapped packages and in particular to a pre-wrapped gift box which, when assembled, has the appearance of a hand wrapped gift package.

2. Description of the Prior Art

The gift wrapping of packages is a reoccurring event which is often a time consuming and frustrating experience. It is difficult, without considerable experience, to properly estimate and accurately cut the correct amount and shape of wrapping paper needed. It is also difficult to tightly and neatly attach the paper to the box. To avoid these problems of hand wrapping packages, a gift wrapping service may be employed, however, this is a relatively expensive alternative.

Pre-wrapped gift packaging is presently known, but its pre-wrapped nature is obvious. That is, the gift receiver may easily tell that the gift was not individually, gift wrapped. For example, packages are commercially available consisting of a pre-wrapped open box bottom and a pre-wrapped box cover. Also, packages with printed external surfaces are presently sold, in theory, eliminating the need for separate wrapping. Similarly, boxes with decorative wrapping paper loosely attached are known.

But the giving of gifts in packages which are clearly and noticeably not hand wrapped may convey a lack of caring or consideration. This is opposite to the sentiment normally sought to be conveyed by the giving of a gift. What is needed is pre-wrapped gift package which, when assembled, provides the pleasing appearance of a hand wrapped gift wrapped box and is which maintains this appearance after being opened.

SUMMARY OF THE INVENTION

The preceding and other shortcomings of the prior art are addressed and overcome by the present invention which provides, in a first aspect, a method forming a wrapped box by forming a substrate with at least three parallel foldable panel joints, forming a pair of foldable flap joints transverse to the foldable panel joints to form foldable substrate flaps at flap ends of the substrate, affixing a decorative wrapping to one side of the substrate, forming at least one wrapping substrate flap at each flap end by affixing the wrapping to at least one of the foldable substrate flaps at each the flap end, forming a separable panel joint by connecting a pair of edges of the substrate transverse to the flap ends, folding all panel joints to erect a box tube surrounded by wrapping extending past each folding flap joint, folding all non-wrapping substrate flaps across the associated flap end, then folding the wrapping substrate flaps across the previously folded flaps to form an opposing pair of wrapping flaps at each end of the box tube, and then securing each opposing pair of wrapping flaps to form a wrapped box.

The separable panel joint may be formed from a foldable end tab along one of the edges affixed to a surface of the substrate.

In another aspect, the present invention provides a method of forming a wrapped box by forming a substrate into a box tube open at a pair of ends by at least temporarily connecting a pair of joint edges of the substrate, each of the ends having two pairs of opposing substrate flaps extending therefrom, forming a pair of opposing wrapping substrate flaps from one of each of the two pairs of opposing flaps at each of the ends by affixing a sheet of wrapping to the substrate at one of the pair of opposing flaps at each of the ends, folding the other pair of opposing substrate flaps at each end across each the end, then folding the pair of wrapping substrate flaps at the end, and then closing each of the ends by securing a pair of opposing wrapping flaps associated with the other pair of opposing substrate flaps whereby an article may be inserted in the box tube before closing both of the pair of ends.

At least one of the other pair of opposing substrate flaps at each end may be left unsecured to the secured substrate flaps. The unsecured flap substrate flap be a substrate flap extending adjacent the connected pair of joint edges.

In a still further aspect, the present invention provides a method of forming a wrapped box by forming a substrate into a box tube open at a pair of ends, each of the ends having one or more flaps extending there from, affixing a sheet of wrapping to the substrate extending beyond at least one of the pair of ends when the substrate is formed into a box tube, affixing the wrapping to at least one of the flaps at each end, closing at least one end by folding any flaps to which wrapping is not affixed, then folding flaps to which wrapping is affixed, then forming a pair of opposing wrapping flaps from wrapping not affixed to a flap, and then closing the end by securing the pair of opposing wrapping flaps, whereby an article may be inserted in the box tube before closing both of the pair of ends.

The pair of opposing wrapping flaps formed from wrapping not affixed to a flap may result from folding a first and then a second flap to which wrapping is affixed. The last folded flap may be secured to an opposing flap without securing the last folded flap to at least one of the non opposing flaps, such as a flap extending from the substrate adjacent the joined pair of substrate edges.

The substrate may be formed into a box tube by at least temporarily joining a pair of edges of the substrate transverse to the open box tube ends. The edges may be joined by forming a foldable end tab along one of the pair of edges, and securing the end tab to the other one of the pair of edges.

These and other features and advantages of this invention will become further apparent from the detailed description that follows, which is accompanied by several drawing figures. In the figures and description, numerals indicate the various features of the invention, like numerals referring to like features throughout both the drawings and the description.

BRIEF DESCRIPTION OF THE DRAWINGS

FIG. 1 is a top plan view of a partially assembled box tube including a flat sheet of box construction material, cut and creased for folding, overlying a flat sheet of gift wrapping attached thereto in accordance with the present invention.

FIG. 2 is a top plan view of the attached sheets of box construction material and wrapping paper shown in FIG. 1 which have been rotated to show the wrapping paper on top.

FIG. 3 is an isometric view of a pre-wrapped package formed from a box tube with end flaps on one end in the open position.

FIG. 4 is the pre-wrapped package shown in FIG. 3 after the end flaps have been folded and folded end portions of the wrapping paper have been creased.

FIG. 5 is a top plan view of the box tube shown in FIGS. 1 and 2 after joining of the joint sides.

FIG. 6 is an end view of the flattened box tube of FIG. 5.

DETAILED DESCRIPTION OF THE PREFERRED EMBODIMENT

The present invention provides an easily formed pre-wrapped package having the pleasing appearance of a hand wrapped box.

Referring to FIGS. 1 and 2, a presently preferred embodiment of the invention includes a generally rectangular sheet 1 of box construction material overlying a piece of wrapping paper 3 affixed thereto. Sheet 1 may be a die cut and creased piece of cardboard or other similarly formed thin sheet of material suitable for gift box construction. Sheet 1 is formed to have body 5, four major end flaps 7 and four minor end flaps 9. Two major end flaps 7 and two minor end flaps 9 are alternately located along each long or flap side of body 5, like sized end flaps opposing each other.

Sheet 1 is creased in several places to facilitate its being folded into a closed box. Horizontal or flap creases 11 define the juncture of body 5 with end flaps 7 and 9 and are the lines along which end flaps 7 and 9 are to be folded. Inner edge 10 of minor end flap 9, for example, lies along horizontal crease 11. Vertical or folding creases 13 form the lines along which body 5 is to be folded and define the width of the sides of the box to be formed.

Each minor end flap 9 is slightly narrower at its outer edge 8, than its crease edge 10, to leave room for the creased wrapper paper in order to produce a cleanly wrapped package that is clearly individually, hand wrapped. For convenience of the description herein, the width of each flap will be considered to be its width along horizontal crease 11, e.g. crease edge 10, while the extension of each flap will be the distance from the edge of the flap along the horizontal crease to the flap outer edge, such as outer edge 8. As noted below, if the assembled gift box is to be square in shape, the widths of all major and minor end flaps 7 and 9 will be approximately the same. The extensions of such flaps will be different as described herein below.

End tab 15 is utilized to form a lap joint with the opposite end of body 5 to hold folded body 5 together when the vertical crease 13 adjacent end tab 15 is folded. The joint may be formed by adhesive material positioned, for example, along tacking strip 16 at the outer edge of end tab 15.

Wrapping paper 3 is affixed to folded body 5 at many points, such as tacking points 14, each of which may be formed by crimping wrapping paper 3 to folded body 5, or by providing a drop of adhesive between wrapping paper 3 and folded body 5, or by any other convenient mechanism which results in the handling and appearance of a hand wrapped box when that box is unwrapped. Rubber cement or other suitable bonding material may be used. In particular, using tacking points between the paper and the box which readily come apart during unwrapping provides a more hand wrapped appearance than a technique, such as surface taping, which would attach the surface of wrapping paper 3 not in contact with folded body 5 to folded body 5. Surface taping between minor end flaps 9 and the edge of wrapping paper 3 adjacent thereto, for example, interferes with unwrapping and imparts the appearance and feel of a non-hand-wrapped package.

Tacking points 14 are positioned as indicated along the inner edges 12 of minor flaps 9 at the intersection thereof with the outer edge 8 of each such flap. Wrapping paper 3 must be adhered along its inner edges 12 to minor end flaps 9 to insure paper flaps 17, as shown in FIG. 4, are properly formed when minor end flaps 9 are folded, as described below. Additional tacking points 14 may be provided wherever convenient or desired for any particular application, except that each major end flap 7 must not be affixed to the portion of wrapping paper 3 adjacent thereto. In addition, it may be convenient to provide tacking points 14 along wrapping paper seam edges 18 and 20, as shown for example in FIG. 2, to form a seam there between.

In addition to tacking points 14 along wrapping paper seam edges 18 and 20, or as an alternate thereto, a small piece of tape, such as tape segment 22, may be used to form the seam. Tape segment 22 may conveniently be used to form the seam between edges 18 and 20 because, during unwrapping, a piece of tape along the paper seam is a normal result of hand wrapping. Tape segment 22 is shown in FIGS. 1, and 2 as attached to first to seam edge 18, for convenience. As shown most clearly in FIGS. 2 and 3, wrapping paper 3 may be affixed to folded body 5 so that the seam formed by joining wrapping paper seam edges 18 and 20 is conveniently positioned along the side of box 19 including major end flaps 7. In this way, when assembled, the seam interferes only minimally with the construction of the box. The seam may also be positioned along the side of the box including a minor flap, but additional tacking points 14 may then be required and the seam may interfere with wrapping paper flaps 17, as shown in FIG. 4.

The relative sizes of major and minor end flaps 7 and 9, and the relationship of the size of wrapping paper 3 with respect thereto, depends on the desired shape of the final box. The box formed from the configurations shown in FIGS. 1, 2, 5 and 6 will be generally rectangular in cross-sectional shape. That is, the shape of the flap end of the box when assembled will be rectangular. The box shown being formed in FIGS. 3 and 4 is generally square in cross-sectional shape.

With regard first to a rectangular box, as shown for example in FIGS. 1, 2, 5 and 6, the extension of each major flap must be no greater than the width of each minor flap 9 so that the major flaps may be folded over each other, each substantially filling the open area formed at each end of box tube 35 during assembly. Although the extension of the major flaps may be shorter than the width of minor flaps, it is desirable for them to be substantially equal to the width of the minor flaps so that each such major flap fills the open end of the box tube 35 when assembled to provide maximum rigidity unless an interlocking or mating flap configuration is used as described below in greater detail. If the extension of the major flap were greater than the width of minor flap, the major flap would be too long to fold into the box tube end opening.

On the other hand, the extension of each minor flap should be no greater than one half the width of each major flap so that when the minor flaps are folded over the folded major flaps, the end of each minor flap will just meet the end of other minor flap to form a butt joint. If the extension of the minor flaps exceeds one half the width of the major flaps, the minor flaps will overlap each other when the box is assembled. This overlapped condition may be noticeable through the paper covering and is therefore usually undesirable unless required for a particular box application. Although the minor flaps may be completely eliminated, the assembled box will be stronger and will more closely resemble a hand wrapped box when unwrapped if the extension of the minor flaps is only slightly less than one half the width of the major flaps.

The length of wrapping paper 3 is simply equal to or slightly longer than the sum of the widths of the pairs of minor and major flaps. If the length of wrapping paper 3 is longer than this sum, the seam between wrapping paper seam edges 18 and 20 becomes an overlapping seam with one such edge overlapping the other. An overlapping seam is consistent with hand wrapping techniques. The required width of the paper, for a rectangular box, is related to the size of the box as follows. Wrapping paper 3 must be wide enough to extend past each horizontal crease 11, along each major end flap 7, a distance equal to at least one half of the width of the minor flap. It is preferable that the paper does not extend past each horizontal crease 11 more than a distance equal to half the width of the major flaps so that wrapping paper flaps 17, described below, may be made neatly without unnecessary overlapping of folded paper.

With regard now to a square box, the width of the major and minor flaps are equal because of the square shape of the box. The extension of each major flap must therefore be no greater than its width while the extension of each minor flap must be no greater than one half its width. Wrapping paper 3 must be wide enough to extend past each horizontal crease 11, along each major end flap 7, a distance equal to one half of the width of the minor flap.

Referring additionally now to FIGS. 3 through 6, sheet 1 is folded along creases 13 forming a box tube 35 having two pair of opposing surfaces. End tab 15 along one joint side of body 5 is adhered to the opposite end of body 5 to fix sheet 1 in the box tube shape. Sheet 1 may be alternatively fixed in its tubular shape by omitting end tab 15 and applying tape along the end portions of the joint sides of body 5, while they are being held closely together, to form a butt joint.

In either event, after end tab 15 is secured to the opposite edge of folded body 5, or a butt joint is formed in folded body 5, folded body 5 may conveniently be refolded flat along a pair of vertical creases 13 which preferably do not include the joint sides of folded body 5 as shown for example in FIGS. 5 and 6. In this folded flat condition, slightly exaggerated in the end view shown in FIG. 6 for ease of illustration, the pre-wrapped gift box assembly of the present invention may conveniently be inserted into a transparent plastic bag and header assembly and shipped, displayed and sold in a conventional hanging retail sales configuration.

To form the assembly shown in FIGS. 5 and 6 into a wrapped gift box, the remaining vertical creases 13 are folded to form an open box tube as shown in FIG. 3. Major end flaps 7 are then folded, one at a time, into the opening of box tube 35 to form one end of box 19. After major end flaps 7 have been folded into the tube formed by folded body 5, minor end flaps 9 are folded inward to rest on the surface formed by folded major end flaps 7. Wrapping paper flaps 17, as shown in FIG. 4, are formed by the folding of minor end flaps 9. Wrapping paper flaps 17 are creased, folded together and taped, completing the formation of the pre-wrapped package. In an alternate embodiment, wrapping paper 3 may be precreased along precrease lines 30 as shown in FIG. 2.

Tape segment 32 may conveniently be preattached to one such wrapping paper flap 17 as shown in FIG. 6 between pre-crease lines 30 so that completion of each side of the gift box is accomplished by taping tape segment 32 on one wrapping paper flap 17 directly to the top or display surface of the mating wrapping paper flap 17. After one side of box 19 has been formed from box tube 35 by folding and taping, the gift or other object may be inserted in box 19 which is then closed by folding and taping the open end of the box tube in the same manner. When completed, box 19 has the appearance of a gift wrapped package, indistinguishable from boxes separately wrapped with gift paper. When box 19 is opened, the separate or fully hand wrapped, paper gift wrapped appearance of box 19 is maintained.

Although one major flap may simply be folding in on the next major flap, there is a substantial advantage in rigidity and strength of the resulting box 19 to use interlocking major end flaps as shown in the figures. Referring now again to FIG. 1, each pair of major end flaps 7 forming one end of box 19 may be made to interlock with each other. In particular, one such major flap may be fitted with extension tabs 25 while the other major flap includes mating tab slots 27. When box 19 is being assembled from flattened tube 35, as shown in FIGS. 5 and 6, the major end flap 7 including mating tab slots 27 is folded first. Then the other major end flap, which includes extension tabs 25, is folded there over. Extension tabs 25 are then inserted in mating tab slots 27 interlocking the major flaps together.

Tabs 25 and slots 27 are the presently preferred means of interlocking the major end flaps in this embodiment of the invention, but other male/female interlocking configurations may be utilized.

A chart of approximate relative dimensions for an exemplar of sheet 1, which may be utilized to form boxes incorporating principles of the present invention, is shown below.

| Box Size | Body | Minor Flaps | Major Flaps | End Tab |
|---|---|---|---|---|
| 6 × 4 × 4 | 6 × 16 | 2 × 4 | 4 × 4 | 6 × 0.75 |
| 7 × 7 × 7 | 7 × 24 | 3.5 × 7 | 7 × 7 | 7 × 0.75 |
| 8 × 8 × 4 | 8 × 24 | 2 × 4 | 4 × 8 | 8 × 0.75 |
| 9 × 4 × 4 | 9 × 16 | 2 × 4 | 4 × 4 | 9 × 0.75 |
| 9 × 9 × 5.5 | 9 × 29 | 2.75 × 5.5 | 5.5 × 9 | 9 × 0.75 |
| 12 × 6 × 6 | 12 × 24 | 3 × 6 | 6 × 6 | 12 × 0.75 |

The flattened box tube 35 shown in FIGS. 5 and 6 may conveniently by packaged, shipped and displayed in the flattened condition as shown.

Having now described the invention in accordance with the requirements of the patent statutes, those skilled in this art will have no difficulties making changes and modifications in the embodiment of the individual elements of the invention in order to meet their specific requirements or conditions. Such changes and modifications may be made without departing from the scope and spirit of the invention as set forth in the following claims.

What is claimed is:

1. A method of forming a wrapped box, comprising the steps of:

forming a thin sheet of material with at least three parallel first creases;

forming a pair of second creases transverse to the first creases to form a plurality of first flaps at each of a pair of flap ends of the sheet;

affixing wrapping to a first surface of the sheet;

forming at least one wrapping first flap at each flap end by affixing said wrapping to at least one of said first flaps at each said flap end;

forming a separable lap joint by connecting a pair of edges of the thin sheet of material transverse to the flap ends;

folding all first creases to erect a box tube having a first and a second flap end, said box tube surrounded by the wrapping extending past each second crease;

folding any first flaps that are not wrapping first flaps across the flap ends of the box tube; then folding the wrapping first flaps across any previously folded first flaps to form an opposing pair of flaps at each flap end of the box tube; and then securing each opposing pair of flaps to form a wrapped box.

2. The method of claim 1, wherein the step forming at least one wrapping first flap at each flap end by affixing said wrapping to at least one of said first flaps at each said flap end further comprises the step of:

affixing said wrapping to a pair of opposing first flaps.

3. The method of claim 1, wherein the step of folding any first flaps that are not wrapping first flaps across the flap end of the box tube further comprises the step of:

securing a pair of opposing first flaps that are not wrapping first flaps to each other.

4. The method of claim 1 wherein the step of forming a separable lap joint by connecting a pair of edges of the thin sheet of material transverse to the flap ends further comprises the steps of:

forming a foldable end tab along one of said pair of edges; and securing said end tab to the other one of said pair of edges.

5. The method of claim 4, wherein the step of securing said end tab to the other one of said pair of edges further comprises the step of:

securing said end tab to a surface of said thin sheet of material.

6. The method of claim 5, wherein the step of securing said end tab to the other one of said pair of edges further comprises the step of:

securing said end tab to a second surface of said thin sheet of material.

7. The method of claim 1 wherein the step of affixing wrapping paper to a first surface of the sheet further comprises the steps of:

affixing a first edge of the wrapping adjacent to a second edge of the wrapping to form a wrapping seam along a wrapping seam on a panel not adjacent said wrapping first flaps.

8. A method of forming a wrapped box, comprising the steps of:

forming a thin sheet of material into a box tube body open at a pair of ends by at least temporarily connecting a pair of joint sides of said thin sheet of material, each of said ends having two pairs of opposing first flaps extending therefrom;

forming a pair of opposing wrapping first flaps from one of each of said two pairs of opposing flaps at each of said ends by affixing a sheet of wrapping to said thin sheet of material at one of said pair of opposing flaps at each of said ends;

folding the other pair of opposing first flaps at each end across each said end; and then folding at least one said pair of wrapping first flaps at said end; and then closing each of said ends by securing a pair of opposing wrapping flaps associated with said other pair of opposing first flaps;

whereby an article may be inserted in the box tube before closing both of said pair of ends.

9. The method of claim 8 further comprises the step of:

securing at least two of said first flaps at each end to each other.

10. The method of claim 9 wherein said step of securing at least two of said first flaps at each end to each other further comprises the step of:

leaving at least one of said other pair of opposing first flaps at each end unsecured to said at least two secured first flaps.

11. The method of claim 10 wherein the step of leaving at least one of said other pair of opposing first flaps at each end unsecured to said at least two secured first flaps further comprises the step of:

selecting the at least one of said other pair of opposing first flaps to be unsecured to said at least two secured first flaps to be a first flap extending adjacent said connected pair of joint sides.

12. A method of forming a wrapped box, comprising the steps of:

forming a thin sheet of material into a box tube open at a pair of ends, each of said ends having one or more flaps extending therefrom;

positioning a sheet of wrapping adjacent a first surface of said thin sheet of material and extending beyond at least one of said pair of ends when said thin sheet of material is formed into a box tube;

affixing said wrapping to at least one or more of said flaps at said at least one of said pair of ends;

closing said at least one of said pair of ends by folding any flaps at said end to which wrapping is not affixed; and then folding at least one or more flaps to which wrapping is affixed; and then forming a pair of opposing wrapping flaps from wrapping not affixed to a flap; and then closing said end by securing said pair of opposing wrapping flaps, whereby an article may be inserted in the box tube before closing both of said pair of ends.

13. The method of claim 12 further comprising the step of:

securing the last folded flap to at least one previously folded flap.

14. The method of claim 13, wherein the step of securing the last folded flap to at least one previously folded flap further comprises the step of:

securing the last folded flap to a flap to which wrapping is affixed.

15. The method of claim 12, wherein the steps of folding said at least one or more flaps to which wrapping is affixed and then forming a pair of opposing wrapping flaps from wrapping not affixed to a flap are accomplished by the steps of:

folding one of said at least one or more flaps at said end to which wrapping is affixed; and then folding a second one of said at least one or more flaps at said end to which wrapping is affixed.

16. The method of claim 13, wherein the step of securing the last folded flap to a previously folded flap further comprises the step of:

securing the last folded flap to an opposing flap.

17. The method of claim 12, wherein the step of closing said at least one of said pair of ends by folding any flaps at said end to which wrapping is not affixed further comprises:

folding at least one flap not opposing the last folded flap.

18. The method of claim 17, wherein the step of securing the last folded flap to an opposing flap further comprises the step of:

securing the last folded flap to the opposing flap without securing the last folded flap to at least one of the non opposing flaps.

19. The method of claim 12, wherein the step of closing said at least one of said pair of ends by folding any flaps at said end to which wrapping is not affixed further comprises:

folding a pair of opposing flaps.

20. The method of claim 19, wherein the step of securing the last folded flap to an opposing further comprises the step of:

securing the last folded flap to the opposing flap without securing the last folded flap to the previously folded pair of flaps.

21. The method of claim 20 wherein the step of forming a thin sheet of material into a box tube open at a pair of ends, each of said ends having one or more flaps extending therefrom further comprises the step of:

forming the box tube by at least temporarily joining a pair of edges of the thin sheet of material transverse to the open box tube ends.

22. The method of claim 21 wherein the step of folding at least one flap non-opposing the last folded flap further comprises the step of:

folding at least one flap extending from the thin sheet of material adjacent said joined pair of edges of said thin sheet of material.

23. The method of claim 18 further comprising the step of:

selecting the at least one flap not the last folded flap to extend from an edge of the thin sheet of material transverse to the open box tube ends.

24. The method of claim 12 wherein the step of forming the box tube by at least temporarily joining a pair of edges of the thin sheet of material transverse to the open box tube ends further comprises the steps of:

forming a foldable end tab along one of said pair of edges; and securing said end tab to the other one of said pair of edges.

25. The method of claim 24, wherein the step of securing said end tab to the other one of said pair of edges further comprises the step of:

securing said end tab to a second surface of said thin sheet of material.

* * * * *